United States Patent [19]

Fox

[11] Patent Number: 4,462,571

[45] Date of Patent: Jul. 31, 1984

[54] FLUID-OPERATED, LOAD-HANDLING APPARATUS

[75] Inventor: Albert D. Fox, Novi, Mich.

[73] Assignee: D. W. Zimmerman Mfg., Inc., Madison Heights, Mich.

[21] Appl. No.: 351,943

[22] Filed: Feb. 24, 1982

[51] Int. Cl.[3] ..... B66D 1/08; B66D 1/48

[52] U.S. Cl. ..... 254/270; 254/360

[58] Field of Search ..... 254/270, 331, 360, 361, 254/264, 386

[56] References Cited

U.S. PATENT DOCUMENTS

| | | | |
|---|---|---|---|
| 2,831,554 | 4/1958 | Reynolds | 254/360 |
| 3,260,508 | 7/1966 | Powell | 254/361 |
| 3,384,350 | 5/1968 | Powell | 254/331 X |
| 3,457,837 | 7/1969 | Powell | 254/331 X |
| 3,901,478 | 8/1975 | Peterson | 254/270 |
| 3,933,388 | 1/1976 | Conboy | 254/270 X |

FOREIGN PATENT DOCUMENTS

| | | | |
|---|---|---|---|
| 2008529 | 6/1979 | United Kingdom | 254/360 |

*Primary Examiner*—John M. Jillions

*Attorney, Agent, or Firm*—Allen D. Gutchess, Jr.

[57] ABSTRACT

A fluid-operated, load-handling apparatus is provided for handling loads of various weights. The apparatus includes a fluid-operated hoist with an elongate member extending downwardly to a load-carrying unit. A pilot fluid-controlled regulator supplies fluid to the hoist and a load-responsive, pilot fluid regulator is carried by the load-carrying unit and supplies pilot fluid to the pilot fluid-controlled regulator. The pilot fluid is varied according to the weight of a load, being higher for heavier loads and lower for lighter loads so that the pressure of the fluid supplied to the hoist is accordingly varied by the pilot fluid-controlled regulator to automatically balance the load carried by the load-carrying unit. The apparatus also can include a brake for preventing the elongate member from moving up or down while loads are being changed or are at rest.

14 Claims, 5 Drawing Figures

FLUID-OPERATED, LOAD-HANDLING APPARATUS

This invention relates to a fluid-operated, load-handling apparatus which is capable of carrying and automatically balancing loads of various weights.

Fluid-operated hoists with various hand controls for changing pressure, which controls are manipulated by an operator, are shown in a number of patents assigned to the assignee of the instant patent application. These include: U.S. Pat. No. 3,260,508, issued July 12, 1966; U.S. Pat. No. 3,325,148, issued June 13, 1967; U.S. Pat. No. 3,384,350, issued May 21, 1968; and U.S. Pat. No. 3,428,298, issued Feb. 18, 1969. The controls of these patents increase or decrease fluid pressure to the hoists to raise or lower the loads. Some of the controls can also regulate the presure of the hoists to balance a particular load. However, the pressures can be set for only one or a few loads of predetermined weight and cannot function with loads of other weights without special adjustments being made through the regulators by the operators. The load-handling apparatus according to the invention enables the fluid-operated hoist to balance loads of various weights in a wide range of values without any adjustment being required whatsoever by an operator.

The fluid-operated, load-handling apparatus includes a fluid-operated hoist, a pilot fluid-controlled regulator supplying fluid to the hoist, and a load-responsive, pilot-fluid regulator for controlling pilot fluid to the pilot fluid-controlled regulator in response to the weight of the load being carried and handled. The fluid-operated hoist can include a housing forming a pressure chamber along with a movable piston in the housing. A cable drum is supported on a ball-screw assembly adjacent the piston. When the piston moves in a lineal path in the housing, the cable drum rotates to raise or lower a flexible elongate member or cable carried thereby, in order to raise or lower the load. However, other fluid-operated hoists can be employed, such as those incorporating a cylinder with a piston therein and with an elongate member or piston rod extending outwardly therefrom.

The pilot fluid-controlled regulator controls the pressure of fluid supplied to the hoist chamber, with this pressure, in turn, being controlled by the pressure of pilot fluid supplied to the regulator. The pilot fluid pressure is controlled by a pilot fluid regulator which is responsive to the weight of the load. The pilot fluid regulator is carried by a load-carrying unit which is connected to the elongate member of the hoist and also to the load. The load-carrying unit includes two members which move toward and away from one another according to the weight of the load, with the pilot fluid regulator being carried by one of the members and engagable by the other to cause the pilot fluid to vary according to the weight being carried and handled by the apparatus. The fluid-operated hoist thereby automatically balances the particular load being handled at that time without any adjustments being required by an operator.

The fluid-operated, load-handling apparatus also preferably includes a fluid-operated brake which prevents raising or lowering of the elongate member connected between the hoist and the load when the load is not being manipulated by the operator and when a different load is to be handled by the apparatus. This is manually controlled by the operator along with a valve for connecting the pilot fluid regulator with the pilot fluid-controlled regulator.

It is, therefore, a principal object of the invention to provide improved fluid-operated, load-handling apparatus for automatically balancing loads of various weights.

Another object of the invention is to provide load-handling apparatus for handling loads of various weights and which has a manually-controlled, fluid-operated brake.

A further object of the invention is to provide improved fluid-operated load-handling apparatus employing a load-responsive, pilot fluid regulator which changes pilot-fluid pressure in accordance with the weight of the load being carried by the apparatus.

Many other objects and advantages of the invention will be apparent from the following detailed description of a preferred embodiment thereof, reference being made to the accompanying drawings, in which.

Figure 1:
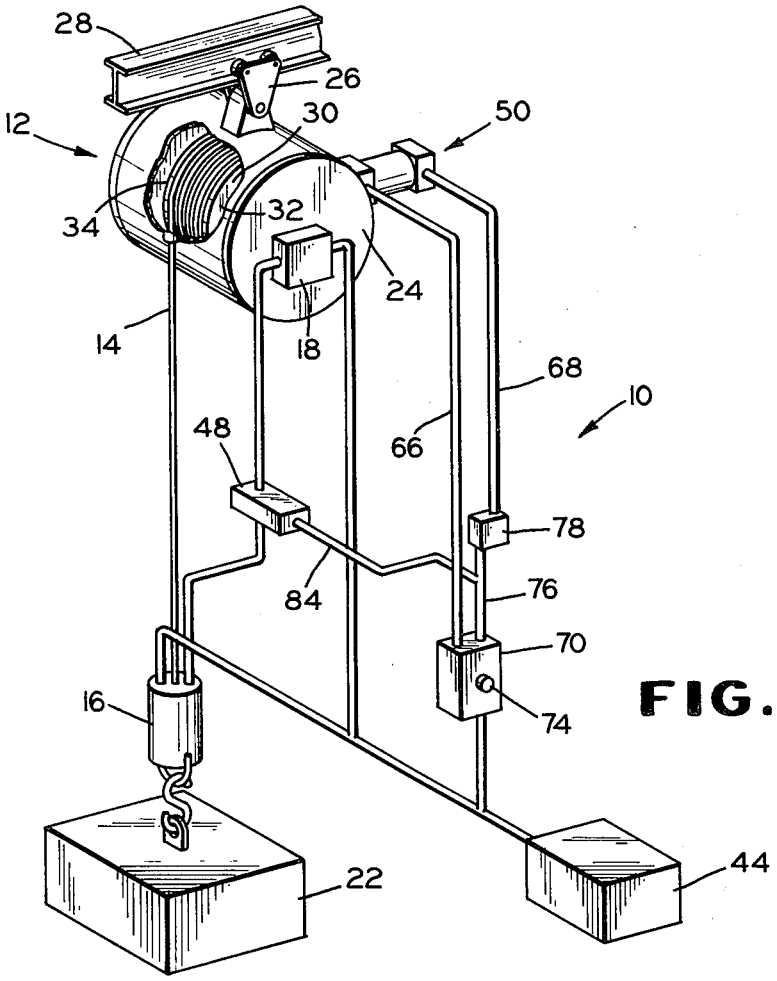
FIG. 1 is a schematic view in perspective of fluid-operated, load-handling apparatus embodying the invention.
Figure 2:
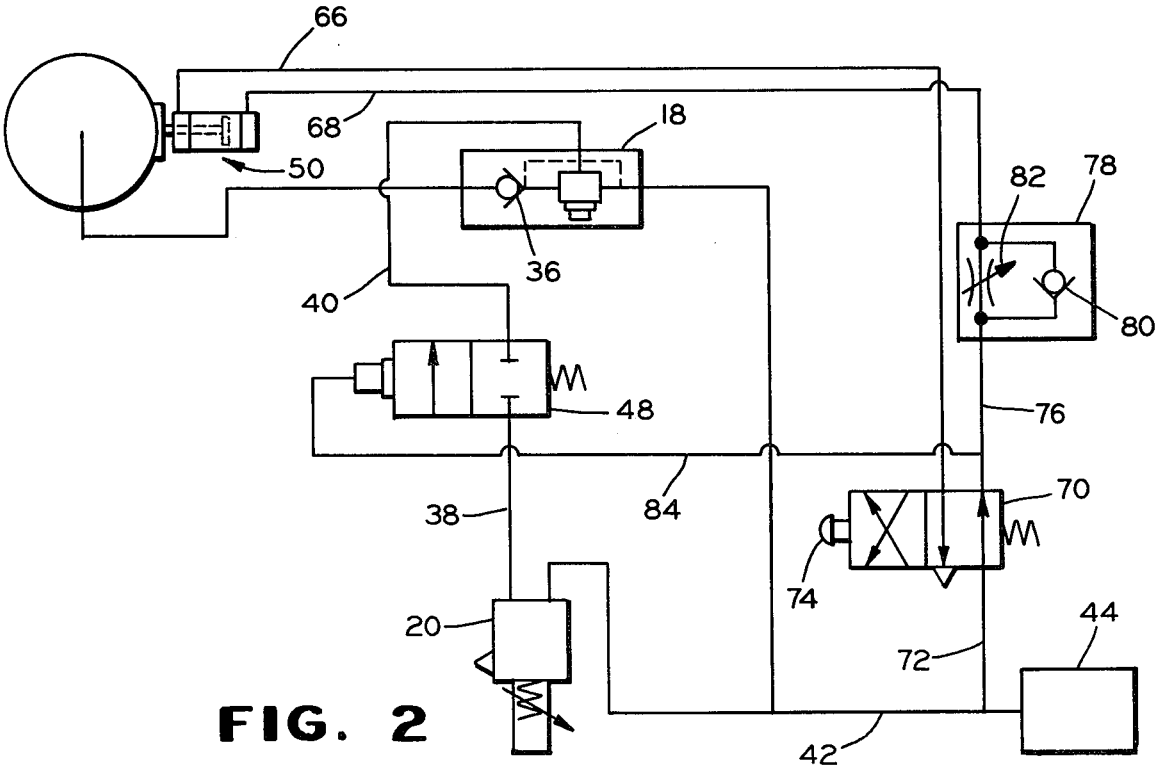
FIG. 2 is a flow diagram diagrammatically showing the components of FIG. 1.
Figure 3:
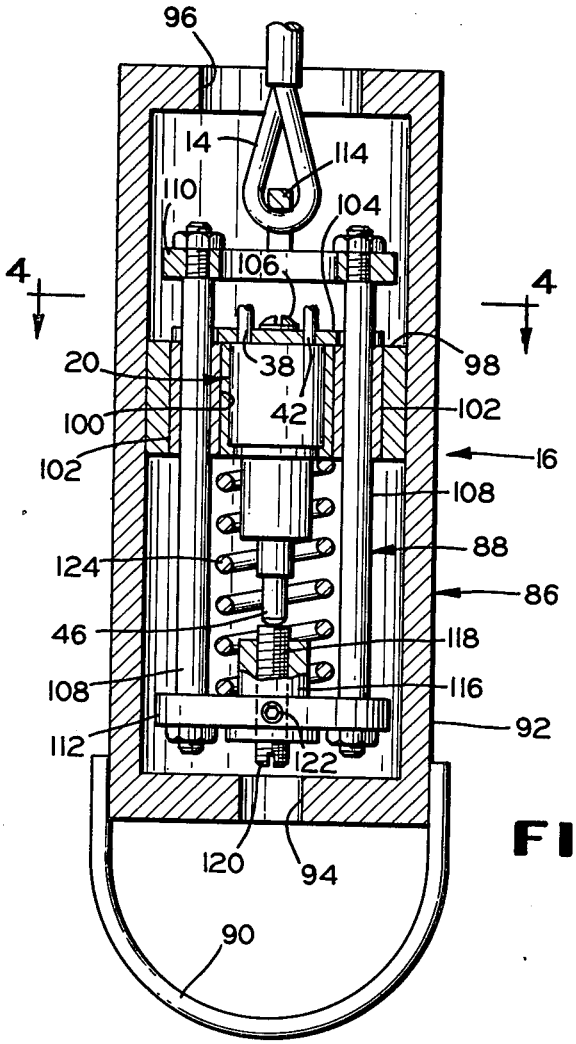
FIG. 3 is an enlarged, somewhat schematic view in vertical cross section of a load carrying unit and a pilot fluid regulator of the apparatus of FIGS. 1 and 2.

Referring to FIG. 1, load-handling apparatus according to the invention is indicated at 10 and basically comprises a fluid-operated hoist 12, an elongate member 14 extending downwardly therefrom to a load-carrying unit 16, a pilot fluid-controlled regulator 18, and a load-responsive, pilot fluid regulator 20 (FIGS. 2 and 3). The pilot fluid-controlled regulator 18 supplies fluid to the hoist and the load-responsive, pilot fluid regulator 20 is carried by the unit 16 and supplies pilot fluid to the pilot fluid-controlled regulator. The pilot fluid pressure is varied according to the weight of a load 22, the heavier the load, the higher the pilot fluid pressure and the lighter the load, the lower the pressure. The pressure of the fluid supplied to the hoist is accordingly varied by the regulator 18.

The hoist 12 includes a housing 24 suspended by a trolley 26 from an overhead rail 28. The hoist housing 24 forms a chamber 30, one end of which is closed off by a piston 32. A cable drum 34 is located adjacent the piston 32 and is rotatably supported on a ball-screw assembly (not shown). This support causes the drum 34 to rotate as the piston 32 moves longitudinally in the housing 24. When the piston moves toward the end of the hoist opposite the chamber, the drum 34 rotates in a manner to raise the elongate member 14, the unit 16, and the load 22. This occurs when the pressure in the chamber 30 is above a particular value. Oppositely, when the pressure in the chamber 30 is below a particular value, the weight of the load 22 on the elongate member 14 causes the drum 34 to rotate in a manner to lower the member 14 and to move the piston 32 toward the chamber end of the hoist, reducing the volume of the chamber.

When the pressure in the chamber 30 is adjusted to a particular value to balance the weight of the load 22, an operator can manipulate the load up and down as if it had substantially no weight, depending upon the friction of the components of the hoist. While the specific type of hoist indicated at 12 is preferred, it is also possible to employ a ram-type of hoist including a fluid-operated cylinder, a piston, and an elongate member or piston rod affixed to the piston and extending downwardly therefrom to be connected to a load. While the piston can be hydraulically or pneumatically operated, it will be specifically set forth as used with air in the following discussion.

The pilot fluid-controlled regulator 18, referred to hereafter as a pilot air-controlled regulator, controls the pressure of the fluid, specifically air, supplied to the hoist chamber 30. The regulator 18 can be of the type shown in U.S. Pat. No. 3,457,837. Specifically, the regulator 18 corresponds to the regulator 74 of that patent although other types of regulators can be employed. An air-operated check valve 36 corresponds to the air-operated check valve 76 of the patent, the check valve 36 automatically closing in the event of failure of the supply air, to prevent air from being exhausted from the chamber 30, in which case, the load 22 could suddenly drop. The pilot air regulator 20 replaces the pilot air regulator 78 of the aforesaid patent.

The pilot air regulator 20 supplies pilot air through lines 38 and 40 to the pilot air-controlled regulator 18. The regulators 18 and 20, in turn, receive fluid or air through a line 42 from a supply 44. The regulator 20 has a spring-loaded plunger 46 (FIG. 3) extending therefrom which controls the pressure output of the regulator. As the plunger 46 extends further into the regulator, the output pressure through the line 38 increases, and vice versa. Similarly, when the higher pilot air pressure is received by the regulator 18, it supplies air under higher pressure to the hoist chamber 30, and vice versa. The pilot air regulator 20 is commercially available, being obtainable, for example, from Fairchild Industrial Products Division located in Winston-Salem, North Carolina, model 70 BR.

A fluid-operated, two-way valve 48 is located between the lines 38 and 40. In a closed, unactuated position, as shown, the pilot air regulator 20 is shut off from the pilot air-controlled regulator 18 with any pilot air then trapped in the regulator 18. In the other position of the valve 48, the regulator 20 communicates with the regulator 18 which can supply higher pressure pilot air thereto or exhaust it therefrom.

Figure 5:
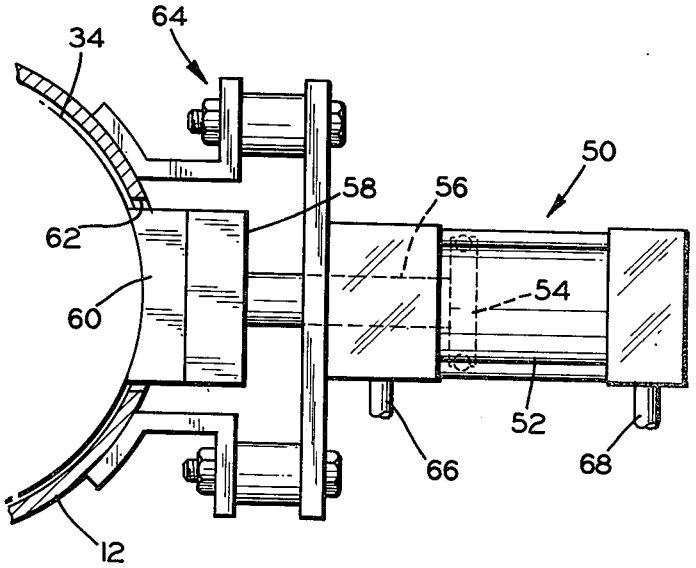
FIG. 5 is a schematic side view in elevation, with parts in cross section, of part of a hoist and a brake shown in FIGS. 1 and 2.

Referring particularly to FIG. 5, a fluid-operated brake 50 can be employed to prevent rotation of the hoist drum 34 to maintain the elongate member 14 in a fixed position. The brake 50 includes a cylinder 52 having a piston 54 therein with a piston rod 56 extending outwardly therefrom. The brake rod 56 terminates in a brake pad 58 to which is affixed a brake shoe 60. This has an arcuate face which engages the periphery of the drum 34 through an opening 62 in the hoist housing 24. The shoe 60 may also engage the extreme outer surface of the elongate member 14, depending upon the extent to which the member 14 is recessed in a spiral groove in the drum 34. The brake 50 is affixed to the housing 12 through suitable brackets indicated at 64.

Fluid, and specifically air, is supplied to the rod end of the brake 50 through a line 66 and to the blind end of the cylinder 52 through a line 68. Air is supplied through the line 66 from a four-way valve 70, a line 72, and the air supply 44. This occurs when the valve 70 is in a right-hand position when a manually-operated button 74 is pressed. When the valve 70 is not actuated, as shown in FIG. 2, air is supplied to the blind end of the cylinder through a line 76, a flow control valve 78, and the line 68. The piston 54 is then extended to cause the brake shoe 60 to engage the hoist drum 34. When the air is supplied through the line 76, it flows unrestrictedly through a check valve 80 of the valve 78 with air exhausted from the rod end of the cylinder through the line 66 to an exhaust port of the four-way valve 70. When air is supplied through the line 66 to the rod end of the cylinder, air is exhausted from the blind end through an adjustable flow-control restriction 82 of the valve 78 so that the air is exhausted more slowly. This prevents premature release of the brake to assure that the valve 48 will function prior to the release of the hoist drum 34.

When the button 74 of the valve 70 is not depressed, air is also supplied through a line 84 to the air-operated valve 48 to move the valve to the actuated position and connect the pilot air regulator 20 with the pilot air-controlled regulator 18. Air is then supplied to the hoist chamber 30 from the regulator 18 at a pressure determined by the pressure of the pilot air. The drum 34 accordingly urges the elongate member 14 and the load 22 up or enables them to move downwardly depending upon this air pressure, when the brake is released. When the button 74 is pressed, air from the valve 48 is exhausted back through the exhaust port of the valve 70 through the line 84 and the valve 48 reverts to the unactuated, left hand position.

Figure 4:
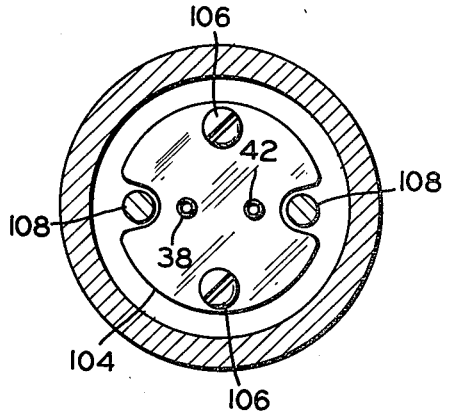
FIG. 4 is a view in transverse cross section taken along the line 4—4 of FIG. 3.

The unit 16 basically comprises a first, load-connecting member 86 (FIGS. 3 and 4) and a second, cable-connecting member 88. The load-connecting member 86 includes a suitable connector 90 affixed to a lower portion of a tubular housing 92 to receive a load hook. The housing also has an access opening 94 at its lower end and a cable-receiving opening 96 at its upper end to receive the cable and the lines 38 and 42. A dividing wall 98 is affixed to and extends across an intermediate portion of the housing 92 and has a central opening 100 to receive the body of the pilot air regulator 20 and two diametrically-opposed bushings 102. The regulator 20 is retained within the opening 100 of dividing wall 98 by an upper mounting plate 104 which is fastened to the top of the dividing wall 98 by suitable fasteners 106.

The cable-connecting member 88 has slidable rods 108 received in the bushings 102 and connected to upper and lower plates 110 and 112. While two of the rods 108 and the bushings 102 are shown for clarity of illustration, three of each are preferred for greater stability. The upper plate 110 has a suitable connector 114 received in a loop at the lower end of the cable 14. The lower plate 112 has a centrally-located, threaded mounting block 116 suitably affixed therein with an adjusting screw 118 extending through the block 116 and threadedly engaged therewith. The adjusting screw 118 has a lower slotted end 120 by means of which the screw 118 can be turned in the block by a tool inserted through the access opening 94. A transverse setscrew 122 engages the side of the screw 118 and can be loosened to permit adjustment of the screw and then tightened to maintain the screw in position. The setscrew is accessible through a slot (not shown) in the side wall of the housing 92. The upper end of the adjusting screw 118 engages the plunger 46 of the regulator 20 and adjusts the output of the regulator, when the screw is turned. Once the screw is properly adjusted for a particular installation, further adjustment is seldom needed.

A large compression spring 124 seats against the lower surface of the wall 98 around the regulator 20 and also seats against the upper surface of the lower plate 112, around the threaded mounting block 116. This spring 124 thereby urges the members 86 and 88 away from one another while the load 22 connected to the connector 90 urges the members 86 and 88 toward one another, causing the adjusting screw 118 to depress the plunger 46 of the regulator 20 more fully and thereby increase the pilot air pressure output of the regulator.

In the operation of the apparatus 10, when the load 22 is connected with the member 86, and when the four-way valve 70 is in the unactuated position of FIG. 2, the brake 50 is set and the two-way valve 48 is actuated to the right hand position to connect the regulators 18 and 20. With the load 22 suspended, the pilot air pressure from the regulator 20 is transmitted through the pilot air-controlled regulator 18 at a value such that the pressure from the regulator 18 to the hoist chamber 30 will be sufficient to automatically balance the suspended load 22. When the button 74 is pressed by the operator, the four-way valve 70 moves to the right-hand position, causing the air to be supplied to the rod end of the brake cylinder 52 and to be exhausted from the blind end through the flow control restriction 82 to the exhaust port of the valve 70. By the time the brake is released, the two-way valve 48 has shifted back to the left-hand position of FIG. 2 with the air exhausted through the line 84 to the exhaust port of the valve 70. Consequently, the pilot air is trapped in the regulator 18 by the now-closed two-way valve 48. The operator can then move the load 22 about easily in its balanced condition. The valve 70 can have a detent or a type of lever such that the valve will remain in the right hand position, as determined by the depression of the button 74, until the valve is manually released. Thus, the operator need not hold in the button 74 while manipulating the load 22.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. Load-handling apparatus comprising a fluid-operated hoist having a chamber and a piston, elongate means moved by said piston and extending downwardly from said hoist for urging a load in one direction when fluid pressure applied to the chamber exceeds a particular value and for being urged by the load in another direction when the pressure applied to the chamber is less than a particular value, a pilot fluid-controlled regulator for applying fluid pressure to said chamber in response to pilot fluid pressure applied to said regulator, and a load-responsive pilot fluid regulator for supplying pilot fluid to said pilot fluid-controlled regulator for increasing pressure of pilot fluid to said pilot fluid-controlled regulator when the load is heavier than a load which was previously carried by said elongate means and for decreasing the pressure of pilot fluid to said pilot fluid-controlled regulator when the load is lighter than a load which was previously carried by said elongate means.

2. Load-handling apparatus according to claim 1 characterized by load-carrying means carried by said elongate means for carrying a load, said pilot fluid regulator being carried by said load-carrying means.

3. Load-handling apparatus according to claim 2 characterized by said load-carrying means comprising a first member connected to said elongate means, a second member for carrying the load, and means engagable between said members for urging said second member upwardly, said load-responsive pilot fluid regulator being carried by one of said members and engagable with the other of said members.

4. Load-handling apparatus according to claim 3 characterized by said pilot fluid regulator increasing the pressure of pilot fluid to said pilot fluid-controlled regulator when said members move toward one another and said load-responsive, pilot fluid regulator decreasing the pilot fluid pressure to said pilot fluid-controlled regulator when said members move away from one another.

5. Load-handling apparatus according to claim 1 characterized by a two-way valve being located between said pilot fluid-controlled regulator and said pilot fluid regulator, said valve having one position in which said regulators can communicate with one another and another position in which pilot fluid is trapped in said pilot fluid-controlled regulator.

6. Load-handling apparatus according to claim 1 characterized by a fluid-operated brake having one position which prevents movement of said elongate means and another position which enables movement of said elongate means.

7. Load-handling apparatus according to claim 6 characterized by a manually-controlled valve for operating said brake.

8. Load-handling apparatus according to claim 7 characterized by a two-way valve being located between said pilot fluid-controlled regulator and said pilot fluid regulator, said two-way valve having a first position in which said regulators can communicate with one another and a second position in which pilot fluid is trapped in said pilot fluid-controlled regulator, said two-way valve being operated by said manually-controlled valve, with said two-way valve being in the first position when said brake prevents movement of said elongate means.

9. Load-handling apparatus according to claim 1 characterized by said fluid-operated hoist having a housing, with said housing and said piston forming said chamber, a hoist drum in said housing and rotatable by said piston as said piston moves in said housing under pressure from fluid in said chamber, said elongate means being carried by said hoist drum.

10. Load-handling apparatus comprising a fluid-operated hoist having a chamber and a piston, elongate means moved by said piston and extending downwardly from said hoist for urging a load in one direction when fluid pressure applied to the chamber exceeds a particular value and for being urged by the load in another direction when the pressure applied to the chamber is less than a particular value, a pilot fluid-controlled regulator for applying fluid pressure to said chamber in response to pilot fluid pressure applied to said regulator, a load-responsive pilot fluid regulator for supplying pilot fluid to said pilot fluid-controlled regulator, and a valve located between said pilot fluid-controlled regulator and said pilot fluid regulator, said valve having one position in which said regulators can communicate with one another and another position in which pilot fluid is trapped in said pilot fluid-controlled regulator.

11. Load-handling apparatus comprising a fluid-operated hoist having a housing, a piston movable in said housing, said housing and said piston forming a fluid chamber, a hoist drum rotatably supported in said housing and rotated as said piston moves in a lineal path in said housing, a flexible elongate member wound on said hoist drum and extending downwardly from said drum for urging a load in one direction when fluid pressure applied to the chamber exceeds a particular value and for enabling the load to move in another direction when the pressure applied to the chamber is less than a particular value, a pilot fluid-controlled regulator for applying fluid pressure to said chamber in response to pilot fluid pressure applied to said regulator, a load-responsive, pilot fluid regulator for applying pilot fluid to said pilot fluid-controlled regulator, load-carrying means carried by said elongate member for carrying a load, said pilot fluid regulator being carried by said load-carrying means, a two-way valve located between said pilot fluid-controlled regulator and said pilot fluid regulator, said valve having one position in which said regulators can communicate with one another and another position in which pilot fluid is trapped in said pilot fluid-controlled regulator, a fluid-operated brake having a brake shoe engagable with and retractable from said hoist drum, and means for controlling the supply of fluid to said brake.

12. Load-handling apparatus according to claim 11 characterized by said controlling means comprising a manually-controlled valve for operating said brake.

13. Load-handling apparatus according to claim 11 characterized by said load-carrying means comprising a first member connected to said elongate means, a second member to be connected to the load, and means engagable between said members for urging said second member upwardly, said load-responsive, pilot fluid regulator being carried by one of said members and engagable with the other of said members.

14. Load-handling apparatus comprising a fluid-operated hoist having a housing, a piston movable in said housing, said housing and said piston forming a fluid chamber, a hoist drum rotatably supported in said housing and rotated as said piston moves in a lineal path in said housing, a flexible elongate member wound on said hoist drum and extending downwardly from said drum for urging a load in one direction when fluid pressure applied to the chamber exceeds a particular value and for enabling the load to move in another direction when the pressure applied to the chamber is less than a particular value, a pilot fluid-controlled regulator for applying fluid pressure to said chamber in response to pilot fluid pressure applied to said regulator, a load-responsive, pilot fluid regulator for applying pilot fluid to said pilot fluid-controlled regulator, load-carrying means carried by said elongate member for carrying a load, said pilot fluid regulator being carried by said load-carrying means, a fluid-operated brake having a brake shoe engagable with and retractable from said hoist drum, means for controlling the supply of fluid to said brake, and a two-way valve located between said pilot fluid-controlled regulator and said pilot fluid regulator, said two-way valve having a first position in which said regulators can communicate with one another and a second position in which pilot fluid is trapped in said pilot fluid-controlled regulator, said controlling means comprising a manually-controlled valve for operating said brake and said two-way valve, said two-way valve being in the first position when said brake engages said hoist drum.

* * * * *